US005266161A

United States Patent [19]

Kroeker

[11] Patent Number: 5,266,161

[45] Date of Patent: Nov. 30, 1993

[54] BAGASSE DEPITHER

[75] Inventor: Gary Kroeker, Gresham, Oreg.

[73] Assignee: Beloit Technologies, Inc., Wilmington, Del.

[21] Appl. No.: 782,709

[22] Filed: Oct. 25, 1991

[51] Int. Cl.[5] ..... D21B 1/00

[52] U.S. Cl. ..... 162/96; 162/55; 209/381; 127/2; 127/43

[58] Field of Search ..... 162/21, 55, 96; 241/94, 241/200; 127/2, 25, 43; 209/234, 404, 413, 320, 381, 382, 403

[56] References Cited

U.S. PATENT DOCUMENTS

| | | | |
|---|---|---|---|
| 731,290 | 6/1903 | Drewsen | 162/55 |
| 749,578 | 1/1904 | Porter | 209/347 |
| 853,943 | 5/1907 | Drewsen | 162/96 |
| 1,155,741 | 10/1915 | Lee | 162/96 |
| 1,399,891 | 12/1921 | Scott . | |
| 1,657,414 | 1/1920 | Silver | 209/308 |
| 1,782,755 | 11/1930 | Williams | 162/96 |
| 1,790,002 | 1/1931 | Darling | 162/96 |
| 1,792,202 | 2/1931 | Valet | 162/96 |
| 1,813,184 | 7/1931 | McQuiston | 162/96 |
| 1,814,552 | 7/1931 | Heyman | 209/381 |
| 1,958,322 | 5/1934 | Symington | 209/308 |
| 2,936,895 | 4/1955 | Cusi . | |
| 3,217,881 | 11/1965 | Wehner | 209/382 |
| 3,302,246 | 1/1964 | Rionda . | |
| 3,317,964 | 11/1962 | Villavicencio et al. . | |
| 3,622,088 | 11/1971 | Gunkel . | |
| 3,796,311 | 3/1974 | Krause | 209/382 |
| 4,231,136 | 11/1980 | Villavicencio . | |
| 4,839,036 | 6/1989 | Slesarenko | 209/382 |
| 5,037,537 | 8/1991 | Bielagus | 209/382 |

OTHER PUBLICATIONS

Knapp et al, Sugar Cane Bagasse as a Fibrous Papermaking Material, Aug. 1957, vol. 40, TAPPI p. 606.

Rydholm, S., Pulping Processes, 1965, pp. 678–681.

Atchison, J. Non-Wood Fiber Pulping—A Progress Report Nov. 1970, TAPPI CA Report #34.

*Primary Examiner*—W. Gary Jones
*Assistant Examiner*—Brenda Lamb
*Attorney, Agent, or Firm*—Dirk J. Veneman; Raymond W. Campbell

[57] ABSTRACT

A method and apparatus for depithing bagasse fibers wherein a horizontal perforate surface such as a screen is provided with means for delivering bagasse onto a delivery end and the screen is given sudden vertical accelerations to accelerate the bagasse upwardly separating the pith from the fibers and driving the pith down through the perforations with the accelerations repeated at sequential localized areas along the screen.

9 Claims, 2 Drawing Sheets

BAGASSE DEPITHER

BACKGROUND OF THE INVENTION

The present invention relates to improvements in bagasse fiber preparation equipment, and more particularly to an improved method and apparatus for depithing bagasse fibers.

In the various fibers available for the making of paper, bagasse has been used for the fibrous content and the substantial volume of bagasse available as a residue of sugar cane, makes the relative economics desirable. A substantial impediment to the wide scale use of bagasse is the difficulty of depithing where the pith is separated from the fibers.

In the processing of sugar cane, the cane is crushed and processed to remove the sugar juice and the bagasse residue is then suitable for processing to obtain bagasse fibers for bagasse paper.

In processes heretofore available, bagasse has been depithed both by wet and dry processes. In both processes, the bagasse is generally mechanically abraded to break the clusters of pith away from the remaining tissue. Dry depithing has been accomplished by using a hammer mill followed by dry screening. The material losses of depithing are considerable and economics dictate that improved bagasse depithing processes are needed to improve the quality of the fibers and avoid loss as well as to reduce the actual costs of depithing.

In processes heretofore available, removal of pith from the fibers has not been fully thorough and traces of the pith remain in the fibers. Varieties in processing bagasse prior to preparing the bagasse fibers for paper by depithing will also vary providing challenges for the satisfactory removal of pith for the preparation of the bagasse fibers. A discussion of processes heretofore employed and the necessity of a substantial removal of nonfibrous constituents from bagasse fibers is discussed in an article entitled "Sugar Cane Bagasse As A Fibrous Papermaking Material", published by TAPPI, Vol. 40, No. 8, Aug. 1957.

FEATURES OF THE INVENTION

An object of the present invention is to provide an improved bagasse depithing method wherein a more rapid and more complete separation of the pith from the fibers of bagasse can be accomplished.

A still further object of the invention is to provide an improved method and apparatus for depithing bagasse fibers wherein the bagasse can be processed dry and an effective separation can occur in a single process.

In accordance with the invention, a flexible perforate surface is provided such as a horizontal extending screen and dry bagasse fibers with the entrained pith is deposited at one end of the screen. The bagasse is given a series of localized vertical sudden accelerations which are sequentially repeated for separation of the pith from the bagasse and for simultaneously driving the pith through the perforate screen below. By passing the bagasse along a screen path and continuing these repeated accelerations simultaneously throwing the bagasse forwardly to the next location where the acceleration is repeated, the separation can occur in a single pass through the machine.

Other objects, advantages and features will become more apparent with the teaching of the principles of the invention in connection with the disclosure of the preferred embodiments thereof in the specification, claims and drawing in which:

DESCRIPTION OF THE PREFERRED EMBODIMENTS

Figure 1:
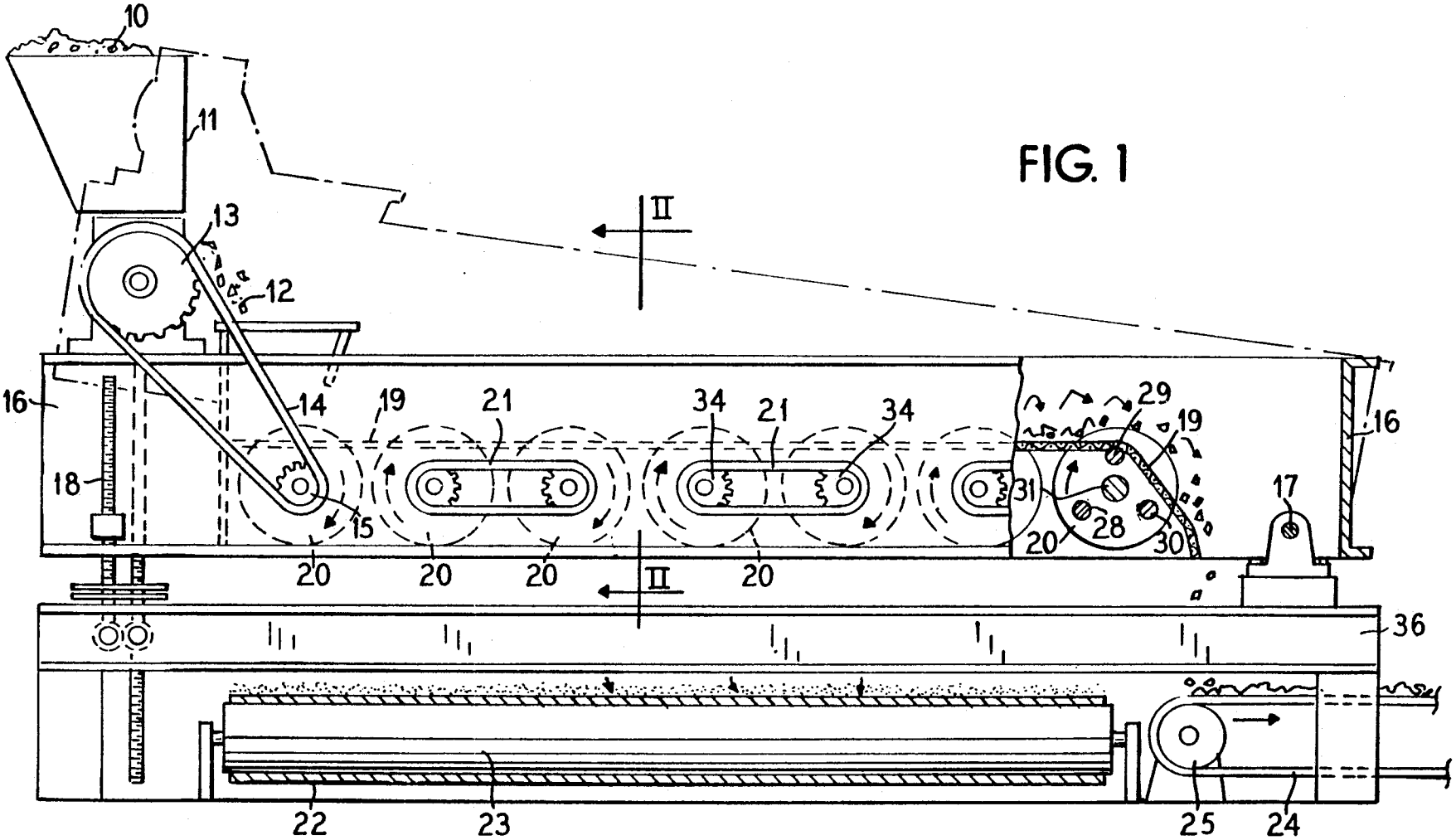
FIG. 1 is a side elevational view shown in somewhat schematic form of an apparatus constructed to operate in accordance with the principles of the present invention to perform the improved method.

As illustrated in FIG. 1, preprocessed bagasse 10 is deposited in a hopper 11 to be fed downwardly at a controlled speed by a rotary feeder driven by a gear 13 operated by a belt or chain 14. The bagasse is deposited downwardly in a uniform distributed flow 12 onto a porous perforate surface 19 shown preferably in the form of a flexible screen.

The flexible screen operates to excite the bagasse in sudden upward accelerations at localized places along the screen 19. This sudden acceleration on the bagasse separates it from the pith and forces the pith downwardly through the screen. Actually, the bagasse is accelerated and thrown upwardly and slightly forwardly in that the screen is given a slight horizontal component of motion to feed it from the head end where it is dropped as shown by the material 12 to the delivery end where it is dropped off onto a conveyor belt 24 receiving the bagasse fibers free of pith. The belt 24 is driven by a roller 25 by suitable drive means.

Figure 2:
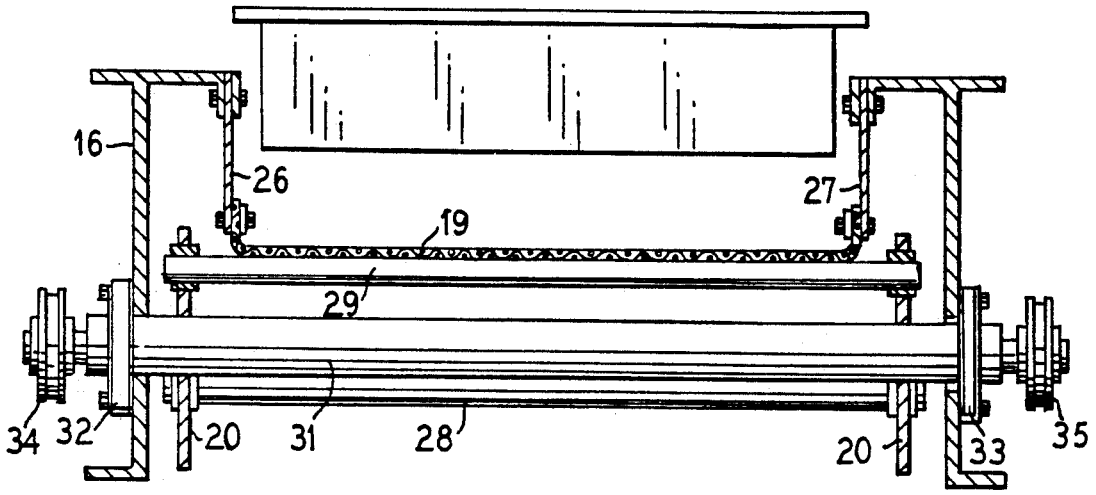
FIG. 2 is a vertical sectional view taken substantially along line II—II of FIG. 1.

As illustrated in FIGS. 1 and 2, the perforate surface or screen 19 is carried on a frame bed 16 which is pivotally supported at 17 at one end and is adjustable at 18 at the other end so as to control the slight discharge angle from the head end to the delivery end of the screen 19. The angle of the bed can be increased or decreased by the rotary screw 18 and the whole unit is supported on a floor frame 36.

As the pith is separated from the bagasse and drops through the screen surface, it is received by a conveyor belt 22 supported on rollers 23 for carrying away the waste pith.

For generating the upward acceleration on the bagasse, the flexible porous screen 19 is repeatedly impacted from below with sudden upward impacts provided by cross bars carried between disks 20, FIG. 2. Impact bars such as 28, 29 and 30, FIGS. 1 and 2, are carried between the disks and as the disks are driven in rotation, the impact bars, rotating in the direction indicated by the arrowed lines, impact the lower surface of the screen thus throwing the bagasse upwardly and forwardly. The disks are arranged in series so that at each location of the disks, the screen 19 is given a fresh vibration or vibrational thrust. For this purpose, the disks are carried on a shaft 31 and the shafts have sprockets at the end such as 34 connected by chains 21 with all of the disks interconnected. As shown in FIG. i, alternate sets of disks are driven at one end while similar drive chains and sprockets are provided at the other end of the disk assemblies. The sprockets are shown generally at 34 and 35 in FIG. 2. The shafts are carried in suitable bearings 32 and 33 at their ends mounted in the frame 16.

In operation when the machine is to be activated, bagasse 10 is deposited downwardly at 12 onto the porous flexible surface 19. As all of the disks are driven in rotation and the porous surface 19 is impacted in sudden severe impacts from below by the cross impact bars 28, 29 and 30, the screen receives an upward thrust at the location of each set of disks with the thrust having a horizontal component throwing the bagasse upwardly and forwardly. By the time the bagasse reaches the delivery end of the machine to tumble down onto the conveyor 24, it is substantially freed of the pith with the fibers and pith being torn apart by the acceleration and the pith free to fall through the porous surface downwardly.

Figure 3:
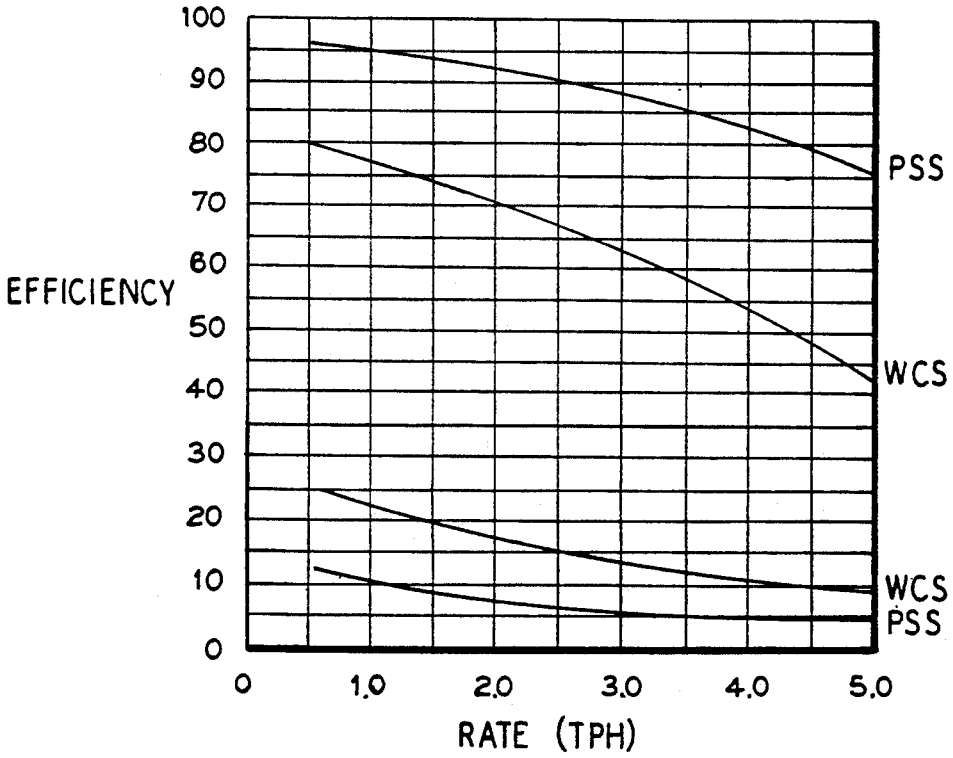
FIG. 3 is a graph presentation of the efficiency of a depithing operation.

FIG. 3 illustrates curves of efficiency versus rate of throughput. The rate is given in tons per hour and efficiency in terms of amount of pith removal. The lower curves labeled WCS and PSS indicate fiber loss and the upper curves labeled PSS and WCS indicate pith removal. It will be noted that the amount of pith removal decreases with increase in rate but the capability of substantial throughput is good. Further, the amount of fiber loss does not diminish substantially with increase in throughput rate.

The curves labeled PSS represent a test conducted with the structure of the present invention, whereas the curves labeled WCS were on a prior art available device sometimes referred to as a western conveyor disk screen. It will be noted that the efficiency of pith removal for the present equipment substantially exceeds that of the prior art structure, and in fact the curve is flatter with increased throughput than the prior art device. Also, in fiber loss the present structure is substantially improved in that the fiber loss is less and the curve is flatter so that increased throughput does not diminish the efficiency of the machine, or in other words, the fiber loss does not substantially increase with increased throughput.

Thus, it will be seen there has been provided a bagasse processing unit and method which meets the objectives and advantages above set forth and provides advantages over processes heretofore available.

I claim as my invention:

1. The method of depithing bagasse fibers from a sugar making process, and subsequently separating the pith from the fiber, comprising the steps:

delivering squeezed and dried, pith containing bagasse fibers onto a horizontal perforate surface of foraminous flexible material;

and imparting to said material sudden, violent, intermittent vertical movements by applying impacts from beneath said material for accelerating the bagasse vertically away from said surface and causing pith to detach from the fibers and pass through the perforate surface.

2. The method of depithing bagasse fibers in accordance with the steps of claim 1;

wherein the vertical accelerations are continually repeated at localized sequential locations along the material for repeatedly accelerating the bagasse upwardly at the sequential locations.

3. The method of depithing bagasse fibers in accordance with the steps of claim 2:

including applying the impacts with a horizontal component for moving the bagasse from one localized location to another along the perforate surface.

4. The method of depithing bagasse fibers in accordance with the steps of claim 2:

wherein the bagasse is deposited vertically on the surface at one location and the bagasse is caused to move horizontally along the surface to other localized sequential locations.

5. The method of depithing bagasse fibers in accordance with the steps of claim 1:

wherein the pith is continually removed from beneath the perforate surface.

6. An apparatus for depithing bagasse fibers and for separating the pith from the depithed fiber, comprising in combination:

a perforate flexible bed extending from a receiving end to a delivery end;

bagasse delivery means positioned above the receiving end delivering the bagasse onto the flexible bed;

and beater means for imparting localized impacts to the lower surface of the bed, to impart vertical acceleration to the bagasse, detaching pith from fibers and forcing the pith through the surface.

7. An apparatus for depithing bagasse fibers constructed in accordance with claim 6.

including means for causing the bagasse to travel along the flexible bed from the receiving end to the delivery end.

8. An apparatus for depiting bagasse fibers constructed in accordance with claim 6:

wherein the localized impacts are provided with a vertical and a horizontal component of movement from the receiving end to the delivery end.

9. An apparatus for depithing bagasse fibers constructed in accordance with claim 6:

including a plurality of rotors below the flexible bed each having horizontally extending bars to impact the flexible bed as the rotors are driven in rotation.

* * * * *

UNITED STATES PATENT AND TRADEMARK OFFICE

CERTIFICATE OF CORRECTION

PATENT NO. : 5,266,161
DATED : 11/30/93
INVENTOR(S) : Gary Kroeker

It is certified that error appears in the above-indentified patent and that said Letters Patent is hereby corrected as shown below:

Column 2, lines 62&63: "FIG.i" should read --FIG. 1--.

Signed and Sealed this

Thirty-first Day of May, 1994

Bruce Lehman

*Attest:*

BRUCE LEHMAN

*Attesting Officer*

*Commissioner of Patents and Trademarks*